US011085007B2

(12) United States Patent
Literski et al.

(10) Patent No.: US 11,085,007 B2
(45) Date of Patent: Aug. 10, 2021

(54) COMPOSITIONS CONTAINING ALPHA-AMYLASE, METHODS AND SYSTEMS FOR REMOVAL OF STARCH

(71) Applicant: ECOCHEM AUSTRALIA PTY LTD, Upper Plenty (AU)

(72) Inventors: Geoffrey Grant Literski, Upper Plenty (AU); Malcolm Robert Dudley, Wantirna South Vic (AU)

(73) Assignee: ECOCHEM AUSTRALIA PTY LTD, Upper Plenty (AU)

( * ) Notice: Subject to any disclaimer, the term of this patent is extended or adjusted under 35 U.S.C. 154(b) by 0 days.

(21) Appl. No.: 17/035,938

(22) Filed: Sep. 29, 2020

(65) Prior Publication Data

US 2021/0017472 A1 Jan. 21, 2021

Related U.S. Application Data

(63) Continuation of application No. 16/636,612, filed as application No. PCT/AU2019/050444 on May 13, 2019.

(30) Foreign Application Priority Data

May 11, 2018 (AU) ..... 2018203281
Sep. 14, 2018 (AU) ..... 2018903477
Mar. 11, 2019 (AU) ..... 2019900791

(51) Int. Cl.

| | |
|---|---|
| ***C11D 1/29*** | (2006.01) |
| ***C11D 3/386*** | (2006.01) |
| ***B08B 3/00*** | (2006.01) |
| ***B31F 1/20*** | (2006.01) |
| ***C11D 1/66*** | (2006.01) |
| ***C11D 3/00*** | (2006.01) |
| ***C11D 3/43*** | (2006.01) |

(52) U.S. Cl.

CPC ..... *C11D 3/38618* (2013.01); *B08B 3/003* (2013.01); *B31F 1/20* (2013.01); *C11D 1/66* (2013.01); *C11D 3/0047* (2013.01); *C11D 3/43* (2013.01); *B08B 2220/04* (2013.01)

(58) Field of Classification Search

CPC ..... C11D 1/29; C11D 3/2068; C11D 3/2037; C11D 3/22; C11D 3/386; C11D 3/28618; C11D 11/0041

See application file for complete search history.

(56) References Cited

U.S. PATENT DOCUMENTS 6,448,212 B1 9/2002 Holderbaum et al.
8,524,648 B2 * 9/2013 Warkotsch ..... C11D 3/2096 510/466
2002/0037824 A1 * 3/2002 Smets ..... C11D 1/72 510/305
2008/0314544 A1 * 12/2008 Gansberger ..... D21H 23/28 162/358.1
2010/0024886 A1 2/2010 Seth
2010/0234271 A1 * 9/2010 Scheuing ..... C11D 3/33 510/465
2011/0212876 A1 * 9/2011 Meek ..... C11D 3/361 510/393
2014/0073036 A1 * 3/2014 Hunt, Jr. ..... C11D 3/38663 435/264
2017/0044466 A1 * 2/2017 van Buskirk ..... C11D 11/00
2018/0104722 A1 * 4/2018 Dudley ..... B08B 3/04
2020/0002693 A1 * 1/2020 Cascao-Pereira ..... D06L 1/14
2020/0339917 A1 * 10/2020 Andersen ..... C11D 3/38618

FOREIGN PATENT DOCUMENTS

| | | | |
|---|---|---|---|
| AU | 2020203197 B2 | | 5/2020 |
| CN | 109055031 A1 | | 12/2018 |
| DE | 2259201 | * | 12/1972 |
| DE | 102004038759 A1 | | 2/2006 |
| EP | 2014177217 A1 | | 6/2014 |
| WO | 2008045096 | * | 4/2008 |
| WO | WO2008045096 A1 | | 4/2008 |
| WO | WO2019213718 A1 | | 11/2019 |

OTHER PUBLICATIONS

Australian Patent Office, Written Opinion of the International Searching Authority, PCT/AU2019/05044, dated Aug. 12, 2019, published as WO2019213718 on Nov. 14, 2019, Woden Act 2606, Australia.
Australian Patent Office, International Search Report of the International Searching Authority, PCT/AU2019/050444, dated Aug. 12, 2019, Woden Act 2606, Australia.
Australian Patent Office, "Examination report No. 1 for your standard patent application," priority AU patent application 2018203281, dated Jul. 13, 2018, Woden Act 2606, Australia.
Australian Patent Office, "International-type search for your provisional application," priority AU patent application 2019900791, dated Mar. 11, 2019, Woden Act 2606, Australia.

(Continued)

*Primary Examiner* — Charles I Boyer

(74) *Attorney, Agent, or Firm* — Louis Ventre, Jr.

(57) ABSTRACT

The present invention is directed to compositions, methods and systems for the removal of starch. The methods include: providing cleaning solution and rinsing fluid along supply line(s); connecting the supply line(s) to one or more cleaning applicators positioned to apply the cleaning solution or the rinsing fluid to one or more surfaces of a starch applicator system; and providing a controller which is able to control application of the cleaning solution and the rinsing fluid through the one or more cleaning applicators. The systems include the components described in relation to the methods. The compositions include about 5 to 15% w/w alpha amylase to break down the starch into water-soluble units; and non-ionic surfactant(s) and/or solvent(s) to react at the interface of the starch and surface it is attached to as well as liquefy the resins.

15 Claims, 7 Drawing Sheets

(56) References Cited

OTHER PUBLICATIONS

Australian Patent Office, "Office action: Notice of Acceptance for your patent application," Office of earlier examination for counterpart AU patent application 2020203197, dated Mar. 11, 2019, filed May 15, 2020, which is a divisional of PCT/AU2019/050444, filed May 13-20, 2019, Woden Act 2606, Australia.
Australian Patent Office, Office action: "Examination report No. 1 for your standard patent application," dated Jun. 18, 2020, issued by the Office of earlier examination for counterpart AU patent application 2020203197, Mar. 11, 2019, filed May 15, 2020, which is a divisional of PCT/AU2019/050444, filed May 13-20, 2019, Woden Act 2606, Australia.
Baxter IP, Applicant amendments dated Aug. 7, 2020 to Australian Office Action preceding allowance of counterpart AU patent application 2020203197, filed May 15, 2020.
Canadian Intellectual Property Office, Office Action on Canadian application 3,072,640, national stage of PCT No. AU2019050444, office action dated Oct. 20, 2020, Gatineau, Quebec, Canada.

* cited by examiner

COMPOSITIONS CONTAINING ALPHA-AMYLASE, METHODS AND SYSTEMS FOR REMOVAL OF STARCH

CROSS-REFERENCE TO RELATED APPLICATIONS

This application is a continuation of application Ser. No. 16/636,612, filed 4 Feb. 2020, which is a U.S. National Stage, 371 application of PCT/AU2019/050444, filed 13 May 2019, which claims priority to Australian application 2018203281, filed 11 May 2018, Australian application 2018903477, filed 14 Sep. 2018 and Australian application 2019900791, filed 11 Mar. 2019, each of which is hereby incorporated by reference herein in its entirety.

FIELD OF THE INVENTION

The present invention relates to compositions, methods and systems for removal of starch.

The invention has been developed primarily for use in and/or with removing starch off surfaces in the industrial printing, paper industry and the corrugated box industry and will be described hereinafter with reference to this application. However, it will be appreciated that the invention is not limited to this particular field of use.

BACKGROUND OF THE INVENTION

Starches are used extensively for industrial applications, including for paper strength and brightness for the paper industry and as a highly effective adhesive for all board grades, from corrugated packaging to plasterboard Starch is by far the most important surface sizing agent. In the size press the dilute starch solution is applied to the surface where it cements the body of the paper and thus increases the paper strength.

Starch is widely used in the paper manufacturing industry. It is used at different stages of the paper making process. Common starches used for the paper making industry are potato and cassava, and in particular countries some forms of starch predominate, such as wheat starch in Australia, tapioca starch in New Zealand and corn starch in the USA. The main processes of sizing, printing, and finishing need starch in substantial quantities.

Some starches may be water soluble, however the starches used in many packaging contexts and in particular in the context of the corrugating packaging industry, often include resin and are not water soluble or at least not sufficiently water soluble to be able to be cleaned effectively with water alone. It can also be problematic to use high pressure spraying of water as this may do damage to components such as bearings in the equipment which may in turn substantially affects the operation of the equipment. Manual scrubbing as an alternative may be time consuming and costly due to labor requirements.

The regular removal of starch from equipment in a commercial chemical process is required as the starch resin used to impart water resistance to corrugating adhesives is retained on the surfaces of the machinery. However, often machinery is allowed to continue to be used in a fouled or excess starch build-up condition which decreases the effectiveness of the equipment in further chemical processing. By keeping the machinery and particularly the starch applicators dean, this can encourage an even spread of starch which in turn means that less starch is used and also less heat is required to cure the starch. This can translate to energy and cost savings, and also reduce the negative impact that unnecessarily high heat conditions may have, in particular in relation to the strength of the paper or board which may weaken under high temperatures In the corrugated box industry, the "converters" that manufacture the boxes comprise as part of their function printing machines to print information on the box material before assembly of the box. There may be large amount of waste in time, ink materials and equipment degradation due to the difficulties in cleaning starch applicators, which when operated in a fouled condition, provide an uneven spread of starch and further upon curing, board warping may result as the starch dries at different rates. This may lead to jamming when the board is fed info the converters, and slow down the speed of production and hence increase the cost of production.

In some applications, solutions for removing starch including corrosive or caustic ingredients may be problematic due to damage to the equipment or the creation of hazardous waste products which result from their application. Additionally, such solutions may be ineffective or impractical because of cost or workplace safety related factors. Furthermore, the processing of waste products resulting from such solutions can be expensive due to factors including disposal costs and/or requirements to further treat waste products before disposal.

It can be understood that the removal of starch has one or more of the following problems:

a) Inconvenience in needing complete shutdown of processing equipment; b) not being undertaken due to loss of processing time or labor requirements; c) Not having equipment at peak ability or properly maintained for long service life due to irregular cleaning;

d) Damage or undesirability when using some chemical cleaners;

e) Ineffectiveness of cleaners on resin-based starches used for water resistance;

f) Difficulty in maintaining cleaning of surfaces over longer cleaning periods;

g) The inappropriateness of existing starch cleaners;

h) The dangerous waste products of some chemical starch removal solutions.

i) Lengthy clean up time for a starch kitchen and other components (e.g. starch lines, applicator, double backer and single facer); and j) Excessive water use.

The present invention seeks to provide compositions, methods and systems for the removal of starch, which will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF INVENTION

According to a first aspect of the present invention, removal of starch is provided by a composition for the removal of starch comprising alpha amylase preferably in a range of 5-15% to break down the starch molecules into smaller water-soluble units.

According to a second aspect of the invention, there is provided a method of removal of starch for removing starch off surfaces comprising:

(i) Providing a composition of alpha amylase to break down the starch molecules into smaller water-soluble units;

(ii) Providing one or more surfactant(s) and/or one or more solvent(s) to react at the interface of the starch and surface it is attached to as well as liquefy the resins; and (iii) Providing a determined time of contact of the alpha amylase.

Preferably, the alpha amylase composition is adapted to break down starch into shorter polymers of glucose that are water-soluble. In a preferred formulation, the alpha amylase composition is adapted to break down starch into smaller molecules such as fructose and maltose.

It can be seen that the invention of removal of starch provides the benefit of an effective method of cleaning without disassembly and without chemical damage to the equipment.

It can be seen that in one form the invention achieves an aim of improved removal with a composition for the removal of starch comprising: alpha amylase in an amount of substantially in the range of 5-15% to break down the starch molecules into smaller water-soluble units; sodium benzoate in an amount of between about 0.01% w/w to about 0.2% w/w; and citric acid present in an amount of 0.01% w/w to 0.5% w/w.

This invention relates to compositions for starch removal and methods of removing starch, and in particular compositions including a combination of one or more surfactant(s), one or more solvent(s) and an enzyme, and methods and systems for the use of same.

Various enzymes may be used in the breakdown of starch, and in particular alpha amylase may be used to break down starch by hydrolyzing its alpha bonds. Since the alpha amylase enzymes act on the surface area of starch, increasing the surface area upon which the enzyme can operate can be advantageous. In operation, the surfactant(s) and/or solvent(s) of the composition may operate to segment portions of starch into smaller portions which in turn increases starch surface area. Calcium in water which may be included in the composition and/or with which the solution may be diluted, may act as a co-enzyme to increase the activity of the alpha amylase.

It can also be important to maintain the enzyme in the appropriate state of acidity or basicity (i.e. pH) to enable the enzyme to operate effectively. It may be particularly advantageous for starch removal compositions to be able to react at, and liquefy the starch resins located at, the interface of a starch and a surface.

According to a third aspect of the invention there is provided a method of removal of starch off surfaces of processing equipment comprising:

(a) Providing a composition of alpha amylase to break down the starch molecules into smaller water-soluble units; and (b) Providing one or more surfactant(s) and/or solvent(s) to react at the interface of the starch and surface it is attached to.

Preferably, the starch is broken down into shorter water-soluble polymers of glucose.

It is further preferred that the water-soluble molecules are one or more of fructose and maltose.

According to a fourth aspect of the invention, there is provided a method of removal of starch for removing starch off surfaces of processing equipment comprising:

a) Providing a composition of alpha amylase to break down the starch molecules into smaller water-soluble molecules; and b) Providing one or more surfactant(s) and/or solvent(s) to react at the interface of the starch and the surface it is attached to as well as liquefy the resins.

The method of the invention may further comprise providing a determined time of contact of the alpha amylase. Preferably, the determined time of contact is 30 minutes or more.

Preferably, the determined time of contact of the alpha amylase includes, within a 24-hour period, a plurality of applications of the composition to the relevant surfaces. Preferably, each application is spaced apart from the other by about to 40 minutes.

The determined time of contact may include one or more applications of the composition to the relevant surfaces during period a period of less than 60 minutes, once per day in a particularly preferred form, the determined time of contact includes application of the composition two times during a period of about 30 minutes.

Preferably, rinsing off the composition is provided with a rinsing fluid after the one or more application(s) of the composition.

Preferably, the determined contact time of the composition of alpha amylase is obtained by recycling the composition around the relevant surfaces. The recycling may occur at substantially regular intervals, such as once per day or once per week. It is preferred that for daily recycling there is provided a determined time of contact of at least 30 minutes. It is further preferred that for weekly cycling there is provided a determined time to contact of at least 2 hours. Alternatively, for less regular removal of heavy starch build-up, the recycling around the relevant surfaces preferably occurs for about 4 or more hours.

The period of recycling is preferably continuous.

Preferably, the temperature range of the composition for recycling is substantially in the range of 35 to 85 degrees Celsius.

Alternatively, or in addition to the recycling method of removing starch, there is provided a method of removal of starch wherein the composition is applied using a manual foaming application. The preferred temperature range of the composition for the manual foaming application is above 40 degrees Celsius, and higher including up to 85 degrees subject to appropriate safety mechanisms being in place.

The manual foaming application may include foaming the composition and applying the foamed composition to the relevant surfaces form which starch is intended to be removed. Foaming may be achieved by foaming means. The foaming means may include running the composition at pressure through a nozzle including a sieve or other means conducive to producing foaming, to produce the foamed composition. The pressure is preferably mains pressure.

The foaming means may include a foaming gun for manually directing application of the foamed composition.

Preferably, the foaming application occurs about once per day. It is particularly preferred that two or three foaming applications are applied over a period of about 30 minutes, once per day.

After recycling or foaming application of the cleaning solution, it is preferred that the rinsing fluid is applied.

According to a fifth aspect of the invention there is provided a method of cleaning a starch applicator system, the method including the following steps: providing a cleaning solution supply line for receiving a cleaning solution; providing a rinsing fluid supply line for receiving a rinsing fluid; connecting the cleaning solution supply line and the rinsing fluid supply line to one or more cleaning applicators, the one or more cleaning applicators being positioned to apply the cleaning solution or the rinsing fluid to a starch applicator roll of the starch applicator system; and providing a controller which is able to control application of the cleaning solution and the rinsing fluid through the one or more cleaning applicators to a length of the starch applicator roll.

The one or more cleaning applicators may include a spray bar positioned to apply cleaning solution or rinsing fluid along a length of the starch applicator roll.

The one or more cleaning applicators may be directed and/or located to enable application of the cleaning solution or the rinsing fluid to one or more of the following components of the starch applicator system, or a combination of the them: a starch pot; a starch tray; any other exterior surface of the starch application system; or a starch delivery or return line. The application of the cleaning solution or rinsing fluid may be directly from the cleaning applicator to the surface to be cleaned, or indirectly from the cleaning applicator such as via circulation through lines after being applied directly to another component such as the starch applicator or tray.

The controller may be able to initiate a cleaning cycle including supplying cleaning solution to the one or more cleaning applicators to apply cleaning solution to the starch applicator roll or other components, and to initiate a rinsing cycle including supplying the rinsing fluid to the one or more cleaning applicators to apply the rinsing fluid to the starch applicator roll or other components.

The controller is preferably able to control a return valve connected to a return line to cause or prevent the cleaning solution or the rinsing agent to drain from a starch tray into a starch pot; the return line connecting the starch tray to the starch pot, and the starch pot being configured to supply starch to the starch tray through a starch pump and a starch delivery line.

Preferably, the controller is able to operate a starch system cleaning mode to: operate the return valve to cause fluid draining from the starch tray to be directed into the starch pot; supply cleaning solution or rinsing fluid to the one or more cleaning applicators for application to the starch applicator roll or other components; and operate the starch pump to return cleaning solution or rinsing fluid from the starch pot through the starch delivery line to the starch tray so as to cycle the cleaning solution or the rinsing fluid through the starch pot, starch pump, starch delivery line and starch tray.

In a preferred form of the invention, the rinsing fluid is water. The rinsing solution may comprising other fluids, and may or may not be water based.

Preferably, the method includes the step of connecting the rinsing fluid supply line to a facility water input.

The method may include the step of providing diluters for diluting the cleaning solution with the water.

The one or more cleaning solution applicators may include one or more starch dam applicators each disposed on a starch dam and positioned to apply at least the rinsing agent to the starch applicator roll outside the one or more starch dams. Preferably, the controller is able to operate in a decal reduction mode to operate the one or more starch dam applicators to apply the rinsing agent to the starch applicator roll outside the one or more starch dams as the one or more starch dams move inwards.

The one or more cleaning solution applicators may include one or more foaming applicators. The cleaning solution may be supplied to the one or more foaming applicators for foaming application. The foaming application is preferably for cleaning external surfaces of the starch applicator system.

The foaming application may include running the cleaning solution at pressure through a nozzle including a sieve to produce foaming of the cleaning solution. The pressure may be mains pressure (which may be pressure regulated).

The one or more foaming applicators may include one or more foaming guns for manually directing application of the foamed solution. The one or more foaming applicators may be able to be manually handled.

The method may include the step of providing a circulation means adapted for circulating or recycling at least the cleaning solution around a circuit. The circuit is preferably a closed loop, however in alternative forms it may be open-ended (i.e. for disposing once it has circulated once around the surfaces), or switchably open or closed.

The circulation means is preferably a circulating pump. Alternatively, or in addition, circulation may be assisted by the effect of gravity and/or mains water pressure (or pressure regulated mains water pressure) on the fluid within the circuit.

In a preferred form, the circuit is a starch system circuit including a starch pot, starch pump, starch delivery line and starch tray. A return line may be provided to create a loop including the starch system circuit components, for recycling fluid around the loop.

In a further preferred form, the circuit is a foaming application circuit including lines for supplying cleaning solution to at least one foaming applicator. Preferably, the foaming application circuit is a closed loop to permit circulating of fluid around the loop.

The method preferably includes the step of providing a heater and/or heat exchanger and/or other means adapted for heating at least the cleaning solution to a determined elevated temperature or maintaining the temperature of at least the cleaning solution. Preferably, the method provides for maintaining at least the cleaning solution at or around a determined elevated temperature along a length of the starch system circuit or a length of the foaming application circuit. The method preferably includes providing a heater, heat exchanger and/or other means for maintaining at least the cleaning solution at or around a determined elevated temperature substantially along the length of the starch system circuit.

Preferably, the method includes retrofitting to an existing starch applicator system the cleaning solution line, the rinsing fluid line, the controller and other components provided in the method(s) or system(s) of the invention described herein. The cleaning solution line and/or the rinsing fluid line may, in part, include (i.e. involve utilizing) existing fluid lines of the existing starch applicator system.

According to a sixth aspect of the invention, there is provided a cleaning system for cleaning a starch applicator system, the system including: a cleaning solution supply line for receiving a cleaning solution; a rinsing fluid supply line for receiving a rinsing fluid; the cleaning solution supply line and the rinsing fluid supply line being connectable to one or more cleaning applicators, the one or more cleaning applicators being positioned to apply the cleaning solution or the rinsing fluid to a starch applicator roll of the starch applicator system; and a controller able to control application of the cleaning solution and the rinsing fluid through the one or more cleaning applicators to a length of the starch applicator roll.

Preferably, the one or more cleaning applicators includes a spray bar positioned to apply cleaning solution or rinsing fluid along a length of the starch applicator roll.

The one or more cleaning applicators may be directed and/or located to enable application of the cleaning solution or the rinsing fluid to one or more of the following components of the starch applicator system, or a combination of the them: a starch pot; a starch tray; any other exterior surface of the starch application system; or a starch delivery or return line. The application of the cleaning solution or rinsing fluid may be directly from the cleaning applicator onto the surface of the component to be cleaned, or indirectly from the cleaning applicator such as via circulation through lines after being applied directly to the surface of another component such as the starch applicator or tray.

The controller is preferably able to initiate a cleaning cycle including supplying cleaning solution to the one or more cleaning applicators to apply cleaning solution to the starch applicator roll or other components, then to initiate a rinsing cycle including supplying the rinsing fluid to the one or more cleaning applicators to apply the rinsing fluid to the starch applicator roll or other components.

The system may include a return line connecting a starch tray to a starch pot, the starch pot being configured to supply starch to the starch tray through a starch pump and a starch delivery line, the return line including a return valve controllable by the controller to cause or prevent fluid draining from the starch tray to be directed into the starch pot.

The controller is preferably able to control the return valve to cause the cleaning solution or the rinsing agent to drain from the starch tray into the starch pot.

The controller is preferably able to operate a starch system cleaning mode able to: operate the return valve to cause fluid draining from the starch tray to be directed into the starch pot; supply cleaning solution or rinsing fluid to the one or more cleaning applicators for application to the starch applicator roll or other components; and operate the starch pump to return cleaning solution or rinsing fluid from the starch pot through the starch delivery line to the starch tray so as to cycle the cleaning solution or the rinsing fluid through the starch pot, starch pump, starch delivery line and starch tray.

There may be provided means to operate turning or rotating of the starch applicator roll during the rinsing and/or cleaning cycles. Preferably, the starch applicator roll is controllable by the controller of the invention to start and stop turning of the applicators during cleaning and/or rinsing cycles.

Preferably, the cleaning system further includes one or more drain valves positioned to drain fluid from the starch tray and the starch pot; and wherein the controller is further able to: operate the one or more drain valves to drain cleaning solution from the starch tray and the starch pot; operate the return valve to cause fluid from the starch tray to be directed into the starch pot; operate the cleaning applicators to apply rinsing fluid to the starch applicator roll; and/or operate the starch pump to return rinsing fluid directed into the starch pot through the return line to the starch tray so as to cycle rinsing fluid through the starch pot, starch pump, starch delivery lines and starch tray.

Preferably, the rinsing fluid is water. The rinsing fluid supply line may be connectable a facility water input.

The system may include diluters for diluting the cleaning solution with the water. Preferably, the diluters are located to dilute the cleaning solution with the water upstream of the heater.

The one or more cleaning solution applicators may include one or more starch dam applicators each disposed on a starch dam and positioned to apply at least the rinsing agent to the starch applicator roll outside the one or more starch dams, Preferably, the controller is able to operate in a decal reduction mode to operate the one or more starch dam applicators to apply the rinsing agent to the starch applicator roll outside the one or more starch dams as the one or more starch dams move inwards.

The one or more cleaning solution applicators include a foaming applicator. The controller is preferably able to supply cleaning solution to the foaming applicator for foaming application. Foaming application is preferably for cleaning external surfaces of the starch applicator system.

The cleaning solution may be run at pressure through a nozzle including a sieve in the foaming applicator to produce foaming of the cleaning solution. The pressure is preferably mains pressure, which itself may be regulated by a pressure regulator.

The foaming applicator may include a foaming gun for directing application of the foamed solution. Preferably, the foaming applicator is able to be manually handled.

The system may include circulation means for circulating or recycling at least the cleaning solution around a circuit. The circuit may be a closed loop, however in alternative forms it may be open-ended (i.e. for disposing once it has circulated once around the surfaces), or switchably open or closed. The circulation or recycling means may be one or more circulating pumps. One of the circulating pumps may be a starch pump.

In a preferred form, the circuit is a starch system circuit including a starch pot, starch pump, starch delivery line and starch tray.

In a further preferred form, the circuit is a foaming application circuit including lines for supplying cleaning solution to at least one foaming applicator.

The cleaning system of the invention may include a heater and/or heat exchanger and/or other means adapted for heating at least the cleaning solution to a determined elevated temperature and/or for maintaining at least the cleaning solution at or around a determined elevated temperature along a length of a circuit (e.g. the starch system circuit and/or the foaming application circuit). Preferably, an existing starch pump may be used in a retrofit installation of the cleaning system for recycling cleaning solution and/or rinsing fluid around the relevant surfaces from which starch is desired to be removed. Preferably, an existing spray bar for application of starch may be used in a retrofit installation to deliver the cleaning solution and/or rinsing fluid to the starch applicator roll.

The heater and/or heat exchanger and/or other means is able to maintain at least the cleaning solution at or around a determined elevated temperature substantially along the entire length of the starch system circuit. Preferably, at least a part of the foaming application circuit is insulated to maintain the temperature of the cleaning solution at or around a determined level, so that the cleaning solution reaching the one or more foaming applicators is at or around the determined level.

The system is preferably adapted to be retrofit to an existing starch applicator system, including to one or more, or a part of one or more, starch supply lines of the existing starch applicator system.

According to a seventh aspect of the invention there is provided a composition for the removal of starch including: alpha amylase in an amount in the range of about to 15% w/w to break down the starch into water-soluble molecules;

a pH control agent to control the acidity/basicity of the composition in the range of about 6 to 8; a non-ionic surfactant in the range of about 3 to 15% w/w; and a solvent adapted to soften the resins in the starch in the range of about 1 to 10% w/w.

The alpha amylase is in a preferred application able to break down the starch to shorter water-soluble polymers of glucose.

In a preferred formulation, the composition includes alpha amylase in an amount in the range of about 8 to 12% w/w. In a most preferred formulation, the composition includes alpha amylase in an amount of about 10% w/w.

In a preferred formulation, the pH control agent is an amount of one or more carboxylic acids. Preferably, the pH control agent is one of citric acid or oxalic acid. In a preferred formulation, citric acid is present in an amount of about 0.01% to 0.5% w/w.

In a preferred formulation, the pH control agent controls the acidity of the composition at about 6.5. In a most preferred formulation, the citric acid is present in an amount of about 0.05% w/w.

In a preferred formulation, the non-ionic surfactant is present in an amount in the range of about 8 to 10% w/w. In a most preferred formulation, the non-ionic surfactant is present in an amount of about 9% w/w. Preferably, the non-ionic surfactant is alkyl polyglucoside.

In a preferred formulation, the solvent is present in an amount in an amount in the range of about 2% to 6% w/w. In a most preferred formulation, the solvent is present in an amount of about 4% w/w. The solvent may be chosen from one of D-limonene, Ethylene Glycol Mono Butyl Ether, or pine oil. The solvent is Ethylene Glycol Mono Butyl Ether in a most preferred formation.

The composition may include a preservative. In a preferred formulation the preservative is sodium benzoate and present in an amount of between about 0.01% w/w to about 0.2% w/w. In a most preferred formulation, the preservative is sodium benzoate and present in an amount of about 0.02%.

The composition is effective for removing starch at a temperature of about 35 to 85 degrees Celsius.

The composition preferably includes water, and the composition (including water) can be further diluted with water. The calcium which may be present in mains water provided for diluting the composition may act as a co-enzyme with the alpha amylase.

According to an eighth aspect of the invention, there is provided a method of removing starch from surfaces of a starch applicator system, including: providing a cleaning solution composition of alpha amylase in the range of about to 15% w/w to break down the starch into water soluble molecules, the composition including one or more non-ionic surfactant(s) and/or solvent(s) to react at the interface of the starch and surface it is attached to as well as liquefy the resins; and providing a determined contact time of the alpha amylase with the starch.

In a preferred formulation, the composition includes a solvent adapted to soften the resins in the starch. In a preferred formulation, the composition further includes a pH control agent to control the acidity/basicity of the composition in the range of about 6 to 8.

Preferably, the composition in operation breaks down the starch into a number of shorter polymers of glucose that are water-soluble.

In a preferred formulation, the cleaning solution includes: alpha amylase in an amount in the range of about to 15% to break down the starch into water soluble molecules; a pH control agent to control the acidity/basicity of the composition in the range of about 6 to 8; a non-ionic surfactant in the range of about 3 to 15% w/w; and a solvent adapted to soften the resins in the starch in the range of about 1 to 10% w/w.

Preferably, the determined contact time is about 30 minutes or more.

Preferably, the determined contact time of the alpha amylase includes, for deeper cleaning and within a 24-hour period, a plurality of applications of the composition to the relevant surfaces.

Preferably, each application is spaced apart from the other by about to 40 minutes.

The determined time of contact may include one or more applications of the composition to the relevant surfaces during period a period of less than 60 minutes, once per day in a particularly preferred form, the determined time of contact includes application of the composition two times during a period of about 30 minutes.

Preferably, rinsing off the composition is provided with a rinsing fluid after the one or more application(s) of the composition.

Preferably, the determined contact time of the composition of alpha amylase is obtained by recycling the composition around the relevant surfaces.

Preferably, the recycling occurs at substantially regular intervals. The recycling may occur about once per week. The recycling preferably includes recycling the composition around the relevant surfaces for about 2 hours or more.

For removal of heavy starch build-up, the recycling around the relevant surfaces preferably occurs for about 4-6 hours.

For more regular cleaning, the recycling may occur about once per day. Preferably, the daily recycling around the relevant surfaces occurs for about 30 to 60 minutes.

Preferably, the recycling period is a continuous period of time (e.g. 45 minutes without interruption).

The method may include the further step of heating the composition to about 35 degrees Celsius or more, but less than 90 degrees Celsius. Heating to about or above 90 degrees Celsius may denature the active enzyme and is preferably avoided. Preferably, the determined temperature of the composition for recycling is about 60 to 80 degrees Celsius.

The method may include providing manual foaming application of the composition. Preferably, manual foaming application includes foaming the composition and manually applying the foamed composition to the relevant surfaces form which starch is intended to be removed. Foaming application is preferably for cleaning external surfaces of the starch applicator system.

Preferably, foaming application occurs about once per day. It is preferred that a plurality of foaming applications is applied during a period of about 30 minutes. In a particularly preferred application, two foaming applications is applied during a period of about 30 minutes.

The preferred temperature for foaming composition is 35 degrees Celsius or more. Higher temperatures are preferred, however safety considerations associated with manual foaming application may require temperatures closer to 40 or 50 degrees Celsius.

According to a ninth aspect of the invention, there is provided a cleaning system for a starch applicator system, including:

a cleaning solution for the removal of starch, the cleaning solution including: alpha amylase in an amount in the range of about to 15% to break down the starch into water soluble molecules; a pH control agent to control the acidity/basicity of the composition in the range of about 6 to 8; a non-ionic surfactant in the range of about 3 to 15% w/w; and a solvent adapted to soften the resins in the starch in the range of about 1 to 10% w/w;

a cleaning solution supply line for receiving the cleaning solution and a rinsing fluid supply line for receiving a rinsing fluid; the cleaning solution supply line and the rinsing fluid supply line being connectable to supply the cleaning solution or rinsing fluid to one or more cleaning applicators, the one or more cleaning applicators being positioned to apply the cleaning solution or the rinsing fluid to at least a starch applicator roll of the starch applicator system; and a controller able to control application of the cleaning solution and the rinsing fluid through the one or more cleaning applicators to at least the starch applicator roll.

Preferably, the one or more cleaning applicators includes a spray bar positioned to apply cleaning solution or rinsing fluid along a length of the starch applicator roll;

The controller is preferably able to initiate a cleaning cycle including supplying cleaning solution to the one or more cleaning applicators to apply cleaning solution to at least the starch applicator roll, then to initiate a rinsing cycle including supplying the rinsing fluid to the one or more cleaning applicators to apply the rinsing fluid to at least the starch applicator roll.

The cleaning system preferably further includes a return line connecting a starch tray to a starch pot, the starch pot being configured to supply starch to the starch tray through a starch pump and starch delivery line, the return line including a return valve controllable by the controller to cause or prevent fluid draining from the starch tray to be directed into the starch pot. The controller is preferably able to control the return valve to cause the cleaning solution or the rinsing agent to drain from the starch tray into the starch pot.

The controller is preferably able to operate a starch system cleaning or rinsing cycle to: operate the return valve to cause cleaning solution or rinsing fluid draining from the starch tray to be directed into the starch pot; supply cleaning solution or rinsing fluid to the one or more cleaning applicators for application to at least the starch applicator roll; and operate the starch pump to return cleaning solution or rinsing fluid from the starch pot through the starch delivery line to the starch tray so as to cycle the cleaning solution or the rinsing fluid through the starch pot, starch pump, starch delivery line and starch tray.

The cleaning system preferably includes one or more drain valves positioned to drain fluid from the starch tray and the starch pot; and the controller is further able to:

a. operate the one or more drain valves to drain cleaning solution from the starch tray and the starch pot;

b. operate the return valve to cause fluid from the starch tray to be directed into the starch pot;

c. operate the one or more cleaning applicators to apply rinsing fluid to at least the starch applicator roll; and d. operate the starch pump to return rinsing fluid directed into the starch pot through the return line to the starch tray so as to cycle rinsing fluid through the starch pot, starch pump, starch delivery lines and starch tray.

Preferably, the one or more cleaning applicators include one or more starch dam applicators each disposed on a starch dam and positioned to apply at least the rinsing agent to the starch applicator roll outside the one or more starch dams.

The controller is preferably able to operate in a decal reduction mode to operate the one or more starch dam applicators to apply the rinsing agent to the starch applicator roll outside the one or more starch dams as the one or more starch dams move inwards.

In accordance with a tenth aspect of the invention, there is provided a cleaning system for a starch applicator system, including:

a cleaning solution for the removal of starch, the cleaning solution including:

a. alpha amylase in an amount in the range of about to 15% to break down the starch into water soluble molecules b. a pH control agent to control the acidity/basicity of the composition in the range of about 6 to 8;

c. a non-ionic surfactant in the range of about 3 to 15% w/w; and d. a solvent is adapted to soften the resins in the starch in the range of about 1 to 10% w/w.

A cleaning solution supply line for receiving the cleaning solution and a rinsing fluid supply line for receiving a rinsing fluid, the cleaning solution supply line and the rinsing fluid supply line being connectable to supply the cleaning solution or rinsing fluid to one or more cleaning applicators, the one or more cleaning applicators being able to be manually handled to direct application of the cleaning solution to selected parts of the starch applicator system.

Preferably, the one or more cleaning applicators includes one or more foaming applicators to foam the composition so that foamed cleaning solution is able to be applied to the selected parts of the starch applicator system.

The systems, method and composition of the invention is particularly adapted for cleaning dried starch.

The features described in relation to one or more aspects of the invention are to be understood as applicable to other aspects of the invention. More generally, combinations of the steps in the method of the invention and/or the features of the composition or system of the invention described elsewhere in this specification, including in the claims, are to be understood as falling within the scope of the disclosure of this specification.

Other aspects of the invention are also disclosed.

BRIEF DESCRIPTION OF DRAWINGS

Notwithstanding any other forms which may fall within the scope of the present invention, preferred embodiments of the invention will now be described, by way of example only, with reference to the accompanying drawings in which.

DESCRIPTION OF PREFERRED EMBODIMENTS

Figure 1:
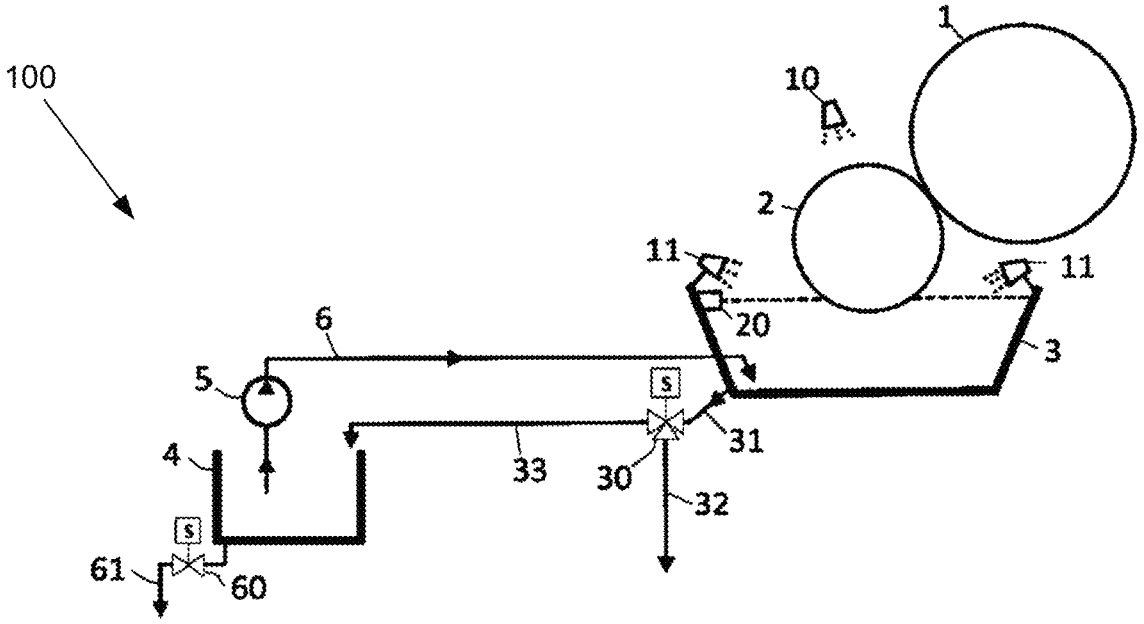
FIG. 1 is a side schematic view of a starch applicator system according to an embodiment of the invention, showing some of the details of the embodiment of removing starch off surfaces in accordance the present invention.

It should be noted in the following description that like or the same reference numerals in different embodiments denote the same or similar features.

Referring to the drawings there is shown methods and systems for removing starch off surfaces.

There is also depicted a method for the removal of starch, and in particular for the removal of starch off surfaces of processing equipment comprising: providing a composition of alpha amylase to break down the starch molecules into smaller water-soluble units; providing surfactants to react at the interface of the starch and surface it is attached to as well as liquefy the resins; and providing a determined time of contact of the alpha amylase.

Operation of Composition

The composition of the invention is to remove starch of surfaces by using surfactants 3-15% (e.g. Alky Poly Glucoside), and solvents 1-10% (e.g. Ethylene Glycol Mono Butyl Ether,) to react at the interface of the starch and surface it is attached to as well as to liquefy the resins. This gives greater surface area for the enzyme alpha amylase (5-15%) to break down the starch molecules into smaller water-soluble units.

The pH is adjusted with Citric acid to about 6.5 to 8 as the chosen alpha amylase operates best at or near this pH range in the proposed composition.

By experimentation by the inventors, it has been determined that the proposed combination of constituents at the proposed pH provides for more effective starch removal, and in particular more effective removal of resin-injected starch, and more particularly still from the surfaces on or around of starch applicators in paper or board manufacturing.

Substantial testing, adjusting of the composition and further testing, showed that efficiencies were obtained in particular ranges of the constituents of the composition. In particular, cost and timing factors are of importance as some of the constituents were expensive and the time-sensitive nature of interrupting production on the equipment to be cleaned also has significant production cost implications. It was determined that the combination of the proposed surfactants and solvents were necessary as a preliminary step before for effective alpha amylase operation, and in particular that non-ionic surfactants and solvents adapted to soften resins in the starch were preferred. Testing further showed that the preferred range for optimization efficiency on relevant cost/timing metrics is: alpha amylase 5-15% w/w, non-ionic surfactant 3-15%, and solvent adapted to soften the resins in the starch 1-10%. Particularly preferred ranges on the same efficacy metrics is alpha amylase 8-12% w/w, non-ionic surfactant 8-10%, and the solvent 2-6%. The most preferred amounts of the constituents are alpha amylase about 10% w/w, nonionic surfactant about 9%, and the solvent about 4%.

The preferred upper amount of amylase being 12% alpha amylase w/w results from an observed flattening out of starch breakdown activity of the composition above that proportion, with the vast bulk of the starch breakdown activity occurring at 12% w/w being achieved with a proportion of alpha amylase about 10% w/w.

The proposed composition is particularly effective in light of the cost of alpha amylase being relatively high compared to some other cleaning product constituents, and as much as 1-2 kg of alpha amylase may be used on a daily basis by a manufacturing plant applying the cleaning solution composition as proposed herein. Furthermore, given an insufficient amount of starch breakdown within a specific timeframe can have substantial consequences in the context of the operation of the composition, optimizing starch breakdown during the determined timeframe is important. Since large volumes of the composition are required to effectively clean the surfaces of or around starch applicators, maximum efficiency of the enzymes may be considered critical.

The most active alpha amylase known to the person skilled in the art is chosen, and the contact time that the solution containing this alpha amylase has with the starch/surface interface is optimized in accordance with the methods and/or systems outlined herein.

The system of the subject invention recommends in one form a recycling of the composition once a week around the relevant surfaces of the processing equipment for about 2-6 hours, depending on starch build-up; and in another form, daily applications by application of a foamed composition on external parts of the system which is restricted to 30 minute applications, preferably a plurality of times each day to take into account production requirements. The desired temperature range for the composition is at least 35 degrees Celsius for manual foaming application and 35-85 degrees Celsius for recycling (except if the system uses PVC pipes, then not above 50 degrees Celsius).

Composition Example 1

| | | | |
|---|---|---|---|
| Water | | 0.7693 (76.93%) | 769.3 |
| Alkyl Poly Glucoside 50% | APG 50 | 0.09 (9%) | 90 |
| Butyl Glycol | | 0.04 (4%) | 40 |
| Citric acid | | 0.0005 (0.05%) | 0.5 |
| alpha amylase | alpha amylase | 0.1 (10%) | 100 |
| Sodium Benzoate | | 0.0002 (0.02%) | 0.2 |

Composition Example 2

| | | | |
|---|---|---|---|
| Water | | 0.7893 (78.93%) | 789.3 |
| Sodium Lauryl Ether Sulphate | SLES | 0.09 (9%) | 90 |
| D-Limonene | | 0.04 (4%) | 40 |
| Citric acid | | 0.0005 (0.05%) | 0.5 |
| alpha amylase | alpha amylase | 0.08 (8%) | 80 |
| Sodium Benzoate | | 0.0002 (0.02%) | 0.2 |

Composition Example 3

| | | | |
|---|---|---|---|
| Water | | 0.6895 (68.95%) | 689.5 |
| Alkyl Poly Glucoside 50% | APG 50 | 0.15 (15%) | 150 |
| Butyl Glycol | | 0.04 (4%) | 40 |
| alpha amylase | alpha amylase | 0.12 (12%) | 120 |
| Oxalic adic | | 0.0005 (0.05%) | 0.5 |

Among all Examples of the composition it is important to have an effect surfactant as well as the right proportion of the right solvent, as too high solvent content may denature the enzyme over timeframes which are non-commercial to permit storage of the composition (e.g. for 1 year). The composition in Example 2 operates at a different pH (8) than the other Example compositions. Also, composition Example 3 does not include a preservative.

The composition may be characterized as a 'cleaning-in-place' starch remover, offering substantial production increases over prior starch removers. It is understood as an optimized blend of enzyme-based detergents designed to remove starch buildups overnight or during downtime, without using corrosive and dangerous caustic or chlorine cleaners.

The composition includes enzymes which are biological molecule catalysts that act on other biological molecules like starch. The enzymes resist being 'used up' in each reaction and can work in the right conditions until all the starch is broken apart and dissolved. Enzymes are understood by persons skilled in the art to be naturally occurring and fully biodegradable.

There may be minimal waste products in the proposed process. By using the proposed composition there may be no need for corrosive cleaners, and by removing undissolved solids and corrosive cleaners from waste water, the waste water process costs can be reduced.

The composition may include small proportions of additives such as Brilliant Blue 5% Solution or like products for coloring purposes. In such compositions, an amount of water is removed from the composition corresponding to the amount of the additive added. In relation to Composition Example 1, if 0.3% blue dye was added, 0.3% water would be removed.

The composition may include small proportions of anti-foaming agents such as SILIFAX, so that the composition including an anti-foaming agent is less subject to foaming after the composition has been used in the removal of starch (e.g. during the processing of the composition as a waste product). When foaming is desired, use of such agents assist to control the amount of foaming.

The composition set out above will be understood by the person skilled in the art to be safe and effective.

The System

Figure 2:
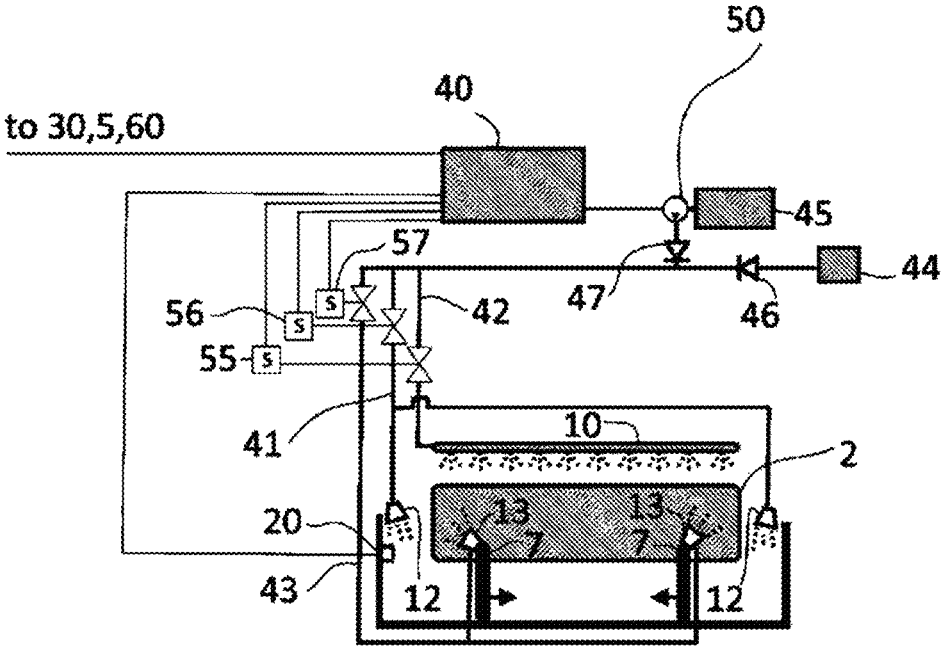
FIG. 2 is a front view of the starch applicator system of FIG. 1, with corrugator rolls omitted from the diagram, showing additional details of the embodiment of removing starch off surfaces in accordance with the present invention.
Figure 4:
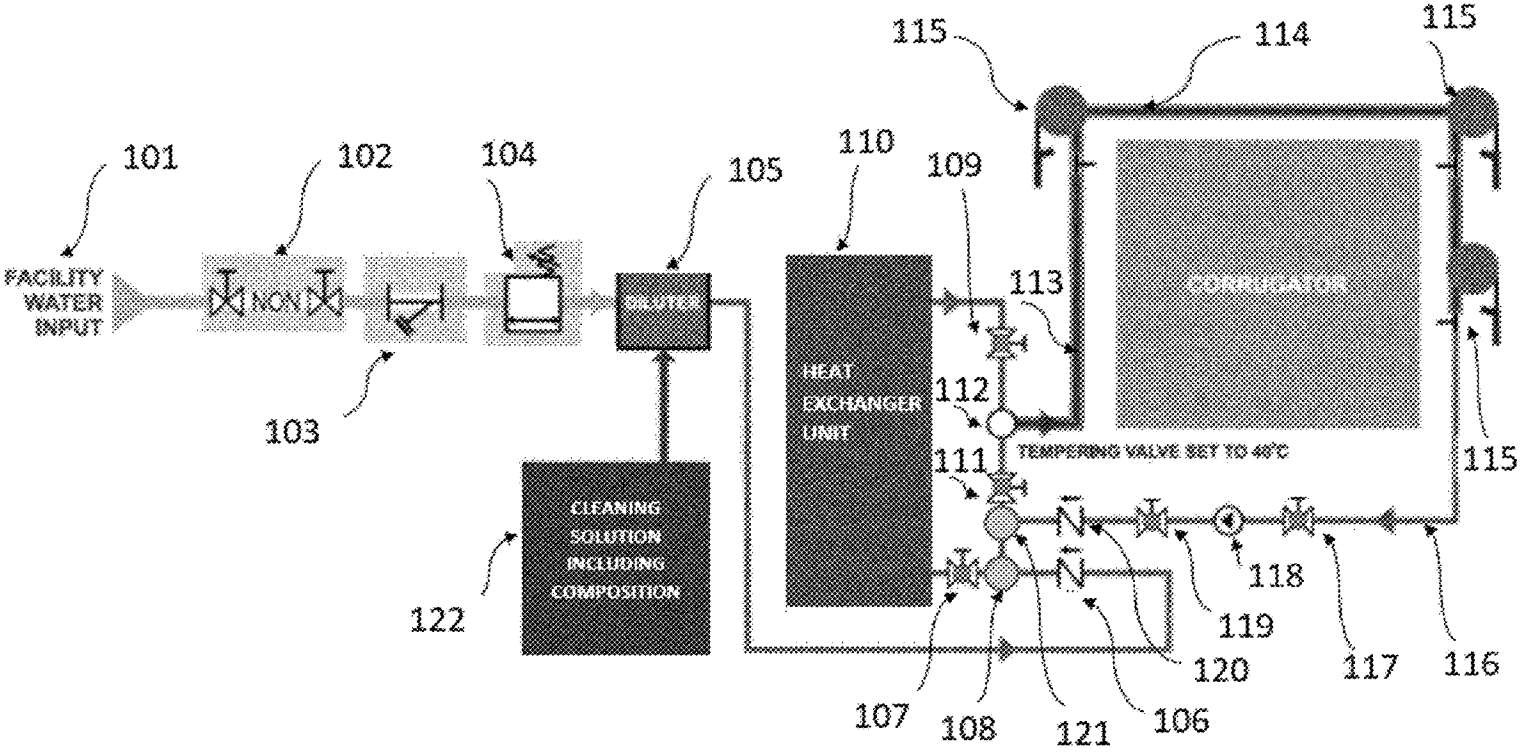
FIG. 4 is a diagrammatic view of a cleaning system for use in the application of the method of cleaning to remove starch in accordance with an embodiment of the invention.

Application of the proposed automated system to a plant a) Install an automated delivery system such as that depicted in FIG. 4 and/or FIGS. 1 or FIG. 2. The installation includes a supplied heat exchanger unit for elevated temperature control and dilution device to a tap and hose to fill pots and/or a foam gun for daily manual application to external surfaces.

b) For deep system cleaning, manually diluted composition from a starch kitchen at a higher temperature of 60-80 degrees Celsius/140-158 F is circulated and recycled through, inter alia, pipes, pumps, tanks, over rolls and glue pots for a minimum of 4 hours weekly. And, c) A suitable position is required for 1000 liter/264 gallon container holding the composition with easy and safe forklift access.

Operating Instructions

Examples of daily and weekly cleaning operations:

For daily cleaning, foam the composition on external equipment, where the composition is diluted with water to 20% and heated to 40 degrees Celsius/104 F controlled by a heat exchange system including coils though which the cleaning solution is able to flow and in this way, the active ingredient of alpha amylase is less susceptive to being denatured.

ii) Reapply every 30 minutes for a few times. Rinse clean with warm/hot water.

iii) For weekly cleaning, dilute concentrate with warm water at 60-80 degrees C./140-158 F heated from the plant's starch kitchen boiler system to make the amount required to circulate through the corrugator. Circulate the composition through system for a minimum 4 hours at 60-80 degrees C. at 10% (1:10) dilution for normal buildup. Dilute to 20% (1:5) and circulate for 4-6 hours for heavy buildup. It is not recommended to use steam injection into the composition, as it is above the optimal temperature and will damage the enzymes. If PVC piping is used, the temperature should be restricted to 50 degrees Celsius.

iv) Rinse system clean with warm/hot water through all the equipment and run to waste.

Product Supply

The composition is supplied in 1000 liter (264 gallon) bulk containers to be diluted at 20% (1:5) to 10% (1:10) with water. It can be applied manually or automatically.

Example System

Referring now to FIGS. 1 and 2, corrugator rolls 1 of a starch application system are adapted to present a gluing surface of paper to engage with one or more starch applicator rolls 2 coated in starch glue, resulting in transfer of a layer of starch glue onto the paper. Starch tray 3 contains a supply of starch glue fed by starch pot 4 through starch pump and supply lines 6. Starch dams 7 as is known in the art are adapted to move in and out to adjust to the decal of the paper being glued. In a manufacturing operation, the widest decal is processed first, and the starch dams 7 are moved inwards as the decal of the paper decreases.

In FIG. 2, thick black lines indicate fluid delivery lines and thin black lines indicate electrical control or sensing connection.

Details of the cleaning system of the current embodiment will now be described.

The embodiment comprises a number of cleaning applicators in the form of spray bars and nozzles 10, 11, 12, 13 which deliver cleaning solution fed from at least one cleaning solution tank 45 diluted with water from a water supply 44, or water alone from water supply 44.

The cleaning solution advantageously comprises alpha-amylase enzyme, which is active to break down starch into soluble sugars. Further ingredients found to be advantageous include solvents or surfactants such as alkyl polyglucoside, pine oil, D-limonene, ethylene glycol mono butyl ether and others. Persons skilled in the art will understand that the particular proportions and blends of solvents and surfactants and enzymes, including those set out in this patent application, can vary and should be chosen to act against the particular composition of the starch glue in the manufacturing process.

Controller 40 is programmed with one or more cycles to conduct cleaning operations during appropriate points in the manufacturing cycle. Controller 40 controls cleaning solution pumps 50, 51, and solenoid valves 55, 56, 57 to control fluid directed to applicator spray bar 10, starch tray spray nozzles 11, 12, and starch dam spray nozzles 13. Starch tray spray nozzles 11, 12 are positioned around starch tray 3 to provide effective coverage and are fed cleaning solution through starch tray cleaning supply line 41. Applicator spray bar is positioned to spray onto the one or more starch applicator rolls 2 and is fed cleaning solution through applicator roll spray bar cleaning supply line 42. Applicator spray bar contains or more spray nozzles along its length to cover the width of the starch applicator roll 2.

A return line 33 connects to a drain line 31 of starch tray 3 via a solenoid operated 3-way valve 30 under program control of controller 40. Operation of the 3-way valve 30 allows cleaning solution from starch tray 3 to pass out to a drain 32 or via return line 33 into starch pot 4. Cleaning solution accumulating in starch pot 4 may then be pumped through starch pump to clean the starch supply lines 6, recycling the cleaning solution into starch tray 3. Starch pot 4 has a starch pot drain line 61 operable through solenoid operated starch pot drain valve 60 under program control of controller 40, enabling excess starch or cleaning solution to be drained from starch pot 4 when appropriate. With this configuration, cleaning solution is able to be circulated automatically under program control of controller 40 around the starch application system and drained away when required.

Controller 40 may be independent of other factory controls or may be interfaced to or part of a manufacturing master controller.

In this embodiment, there are two modes of operation of controller 40.

A first mode is a decal reduction cleaning cycle. This involves cleaning using water an outside region of starch applicator roll 2 during production as the decal of the paper decreases from a wide to a narrow setting. During this manufacturing operation, the starch dams 7 move inwards under the control of a manufacturing master controller, fulfilling their normal function to confine the starch in starch tray 3 inside the barrier presented by the starch dams 7 to the new decal limits.

The cleaning system controller 40 activates solenoid valve 57 feeding water from water supply 44 to starch dam spray nozzles 13, and as the starch dams 7 travel inwards, starch dam spray nozzles 13 wash residual starch off the outer regions of starch applicator roll 2, preventing residual starch outside of the narrowing decal limits on the starch applicator roll 2 from being deposited onto corrugator roll 1.

Since there is only a very thin layer of starch to remove from this area during production, the amount of water used in the spraying a small and the dilution is not significant, considering particularly that the starch typically loses water due to evaporation from the temperature of the system during production.

A second mode is a full system clean with cleaning solution after the end of a manufacturing run. This involves an initial draining of excess starch from starch tray 3 through starch tray drain line 31 with three-way valve 30 directed to drain 32, and similarly an initial draining of excess starch from starch pot 4 through drain line 61 under operation of starch pot drain valve 60.

After completion of the initial draining of excess starch, a cleaning cycle is initiated by an operator entering a code to insure against false triggering of the system at an inappropriate time.

After entry of the code, controller 40 operates three-way valve 30 to direct fluid to starch pot 4 and closes valve 60, and then operates cleaning solution pump 50 and opens solenoid valves 55 and 56 feeding cleaning solution to spray bar and starch tray spray nozzles 11, 12 respectively. The cleaning solution falls into starch tray 3 and passes through drain line 31 and return line 33 into starch pot 4. Starch pump returns cleaning solution through starch supply line 6 into starch tray 3, creating a cycle of cleaning solution between starch tray 3, starch pot 4, starch pump and starch supply line 6. The cleaning solution is allowed to accumulate in starch tray 3 until a level of the cleaning solution rises to level probe as detected by controller 40. At this point, cleaning solution pump 50 and solenoid valves 55, 56 feeding spray bar and starch tray spray nozzles 11, 12 are shut off. If level probe detects a drop in the level of cleaning solution in starch tray 3, cleaning solution pump 50 and at least solenoid 56 feeding starch tray spray nozzles 11, 12 are reopened until the level is sensed by level probe as restored. The cleaning solution is circulated in this manner for a predetermined time, which may be adjusted in controller 40 from experience gained in the time required to clean to a desired standard.

After the lapse of the predetermined time, cleaning solution pumps 50 and 51 are shut off and 3-way valve 30 is opened to drain cleaning solution away through starch tray drain line 32 and starch pot drain valve 60 is opened similarly to drain cleaning solution from starch pot 4 through starch pot drain line 61.

After a further time sufficient to drain the cleaning solution, a rinse cycle is initiated by controller 40. 3-way valve 30 and starch pot drain valve 60 are closed by controller 40. Solenoid valves 55 and 56 are opened, allowing fresh water from water supply 44 without cleaning solution to enter the system, and the same circulating and draining actions as in the above-described cleaning cycle are performed with the exception that the cleaning solution supply pumps 50, 51 are not operated.

Finally, after a predetermined time 3-way valve 30 and starch pot drain valve 60 are again closed by controller 40, completing the full system clean mode. The starch applicator system is now fully cleaned, and starch may be added to starch pot 4 for a new manufacturing session.

Figure 3:
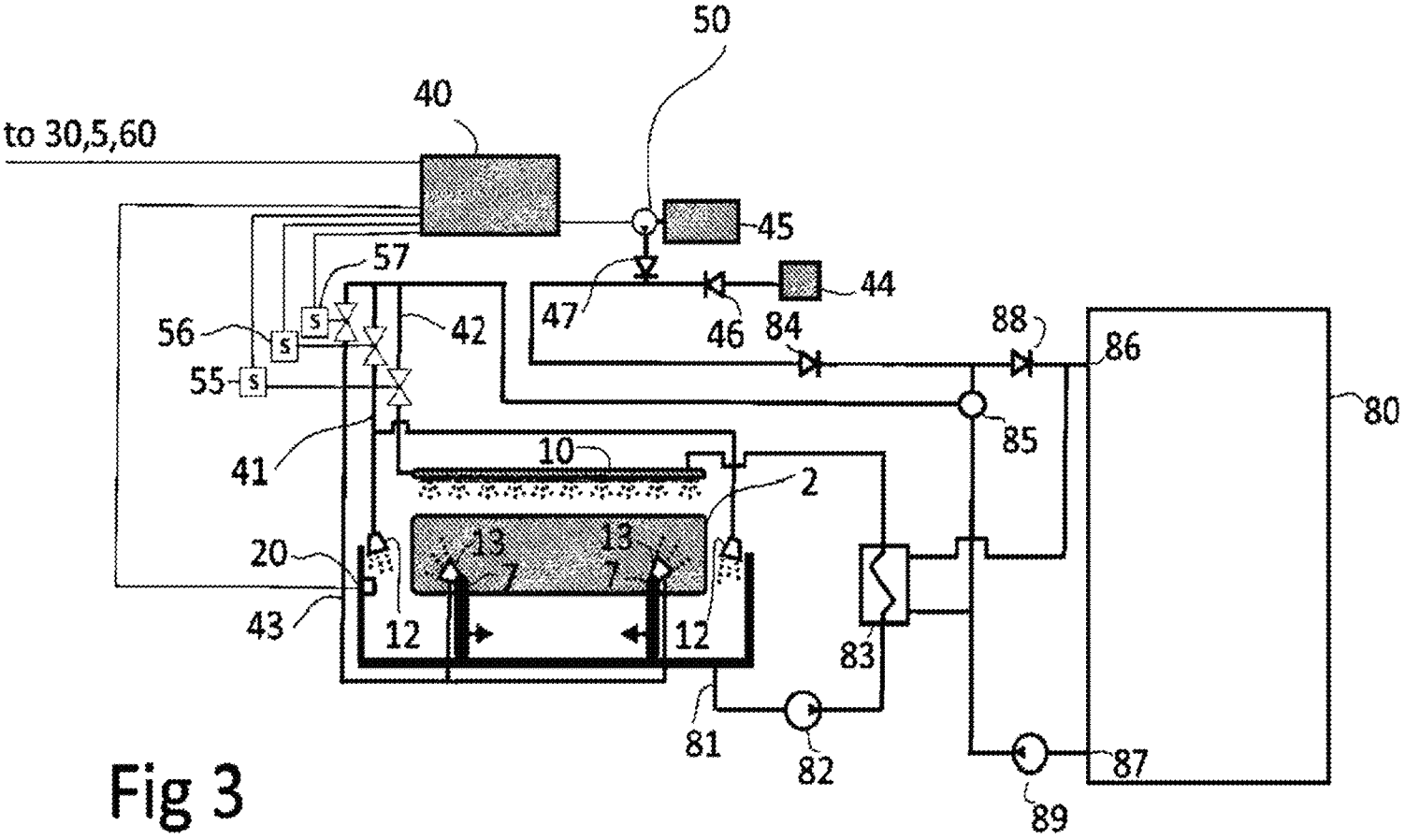
FIG. 3 is a diagrammatic view of the system showing is a variant of the embodiment of FIGS. 1 and 2 incorporating a fluid heater.

Referring now to FIG. 3, a variant of the embodiment described above is shown incorporating a heating circuit to maintain a temperature of at least the cleaning solution at a desired elevated temperature. In testing of prototypes of the invention, it has been found that greater efficacy is produced if the cleaning solution can be heated to a determined elevated temperature, typically above 40 degrees Celsius, which improves enzyme activity while remaining safe to handle. Diluted cleaning solution or water passes through non-return valve 84 and a portion passes through inlet 86 and outlet 87 of heater 80, temporarily heating the cleaning solution or water to an initial temperature of 80 degrees Celsius.

A tempering valve 85 mixes unheated cleaning solution or water with heated cleaning solution or water to the determined elevated temperature of 70 degrees Celsius, which then passes on to clean or rinse the system as described above.

A return line 81 draining starch tray 3 recirculates cleaning solution or water through heat exchanger 83, maintaining the elevated temperature at the spray bar for a duration of the cleaning or rinsing period.

Circulating pump 89 circulates heated cleaning solution or water from the outlet of tank 80 through the heat exchanger 83 and back to inlet 86 of tank 80. Non return valve 88 prevents circulated heated cleaning solution or water from entering upstream.

While the preferred range of determined elevated temperatures is above 40° C., elevated temperatures in the range 60 degrees Celsius to 80 degrees Celsius can be effective and safe, depending on the type of application.

It will be appreciated that in different embodiments, in addition to or instead of starch tray 3, return line 81 can also or alternatively be connected to starch tray drain line 31 or starch supply line 6, or combinations thereof.

The heating circuit may also be controlled and selectively activated through controller 40 and appropriate solenoid-controlled gate valves (not shown).

Referring to FIG. 4 there is depicted a diagrammatic view of a cleaning system for use in the application of the method of cleaning to remove starch in accordance with an embodiment of the invention. This system provides for cleaning via use of foaming guns to apply the foamed composition to the relevant surfaces form which starch is intended to be removed; this system also provides for recycling of the composition through the piping, valves, and the starch tray and starch pot (not shown) of the corrugator. A heat exchanger forms part of the installation, and is set in the embodiment to 65 degrees Celsius to initially heat the composition solution to the temperature which enables tempering to 40 degrees Celsius for effective and safe starch removal.

With further reference to FIG. 4, there is depicted a facility water input 101, comprising a cold water supply being approximately mm diameter wide input. Next down the line there is depicted a RPZ testable non-return valve 102, followed by a Y filter strainer 103, then a pressure regulator 104 comprising a pressure limiting valve (set at 4.5 Bar). The pressure from the mains water supply assists in moving the fluid (including the cleaning solution later injected into the supply) along the lines of system, moving the fluid through the heat exchanger unit 110 as well as producing foaming at the foaming guns 115 located around the foaming application circuit.

The next item along the flow path is a dilutor 105 comprising 2 hydraulic dosing/injecting devices (e.g. MIXRITE injector) both set at 10%, the two injector devices are connected in line, with one device running through to the next device and both devices (not shown) are connected to the intermediate bulk container (IBC) containing the composition 122. The IBC comprises a 264 gallon or 1000 L tank.

Next down the line is a non-return valve 106, followed by a tee pipe fitting 108 which acts to connect (i) the cold water and composition mixture supply that passes through the gate valve 106, (ii) the heat exchanger unit 110, and (iii) the tempering valve 112. A shut-off valve (here, a gate valve) 107 is provided in between the tee 108 and the heat exchanger unit 110. The heat exchanger unit is in this application set to 65 degrees.

Upstream of the tee 108 is a further tee 121 which provides a return pipe line to the tempering valve 112, which provides temperature control at 40 degrees Celsius. In between the further tee 121 and the tempering valve 112 is a further shut-off valve 111. The tempering valve 112 provides connection to a partially insulated line of piping 113 looping around the corrugator (i.e. the processing equipment). Along the line of insulated piping 113, which comprises mm RIFENG piping, there are 3 hose reels, each with a foaming gun 115 and a tap with a hose at each starch applicator of the corrugator (not shown). The insulation along the piping between the tempering valve 112 and the most downstream foaming gun 115 comprises flexible lagging which is 13 mm thick 114. In between the tempering valve 112 and heat exchanger unit 110 is a further shut-off valve 119.

Down the line from the most downstream foaming gun 115 is a return line 116 comprising mm RIFENG piping that is not insulated/lagged, as this aids in the cooling down of the composition within the piping. In an alternative embodiment the return line diameter may be as small as mm, but it is not recommended to be less than that, as the line needs to permit expansion and contraction of the piping as it heats up and cools down depending on the cycle. Completing the loop, along the return line there is included a further shut-off valve 117, small circulating pump 118 for pumping the composition around the loop, and a final shut-off valve 119, followed by a non-return valve 120.

Figure 5:
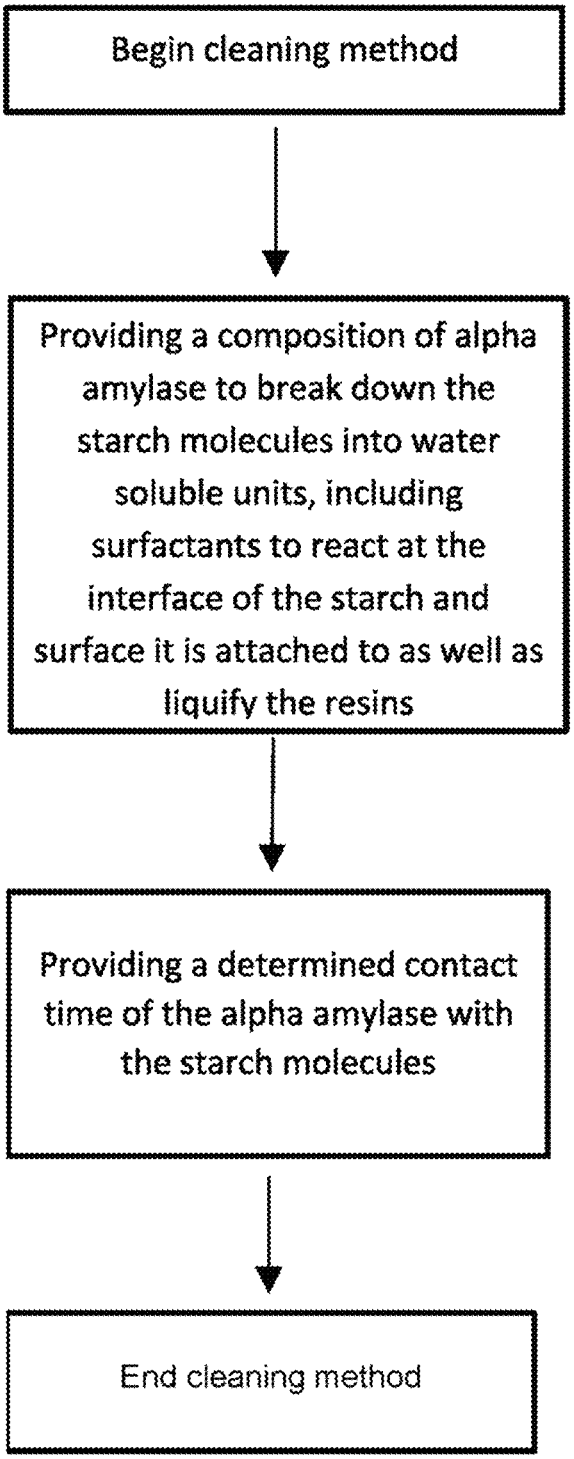
FIG. 5 is a flow diagram of the steps of a method to remove starch in accordance with a method of the invention.

Referring to FIG. 5 there is shown a method of removing starch off surfaces of processing equipment comprise a) Providing a composition of alpha amylase to break down the starch molecules into smaller water-soluble units, the composition including surfactants to react at the interface of the starch and surface it is attached to as well as liquefy the resins; b) Providing a determined time of contact of the alpha amylase and the starch molecules.

The alpha amylase is about 10%. The determined time of contact of the alpha amylase is at least 30 minutes.

The composition of alpha amylase is able to be recycled once a week for at least 2 to 6 hours, depending on the amount of starch to be removed.

The composition may be applied in a manual foaming application and/or recycling around surfaces of the starch applicator system to be cleaned. The preferred temperature range for the composition is substantially in the range of 35-45 degrees Celsius for manual foaming application. The preferred temperature range for recycling is substantially in the range of 60-80 degrees Celsius.

The pH of the composition is maintained at about 6 to 8 by including a pH control agent such as citric acid, to optimize the effect of alpha amylase. The citric acid is present in an amount substantially in the range of 0.01% w/w to 0.5% w/w.

Figure 6:
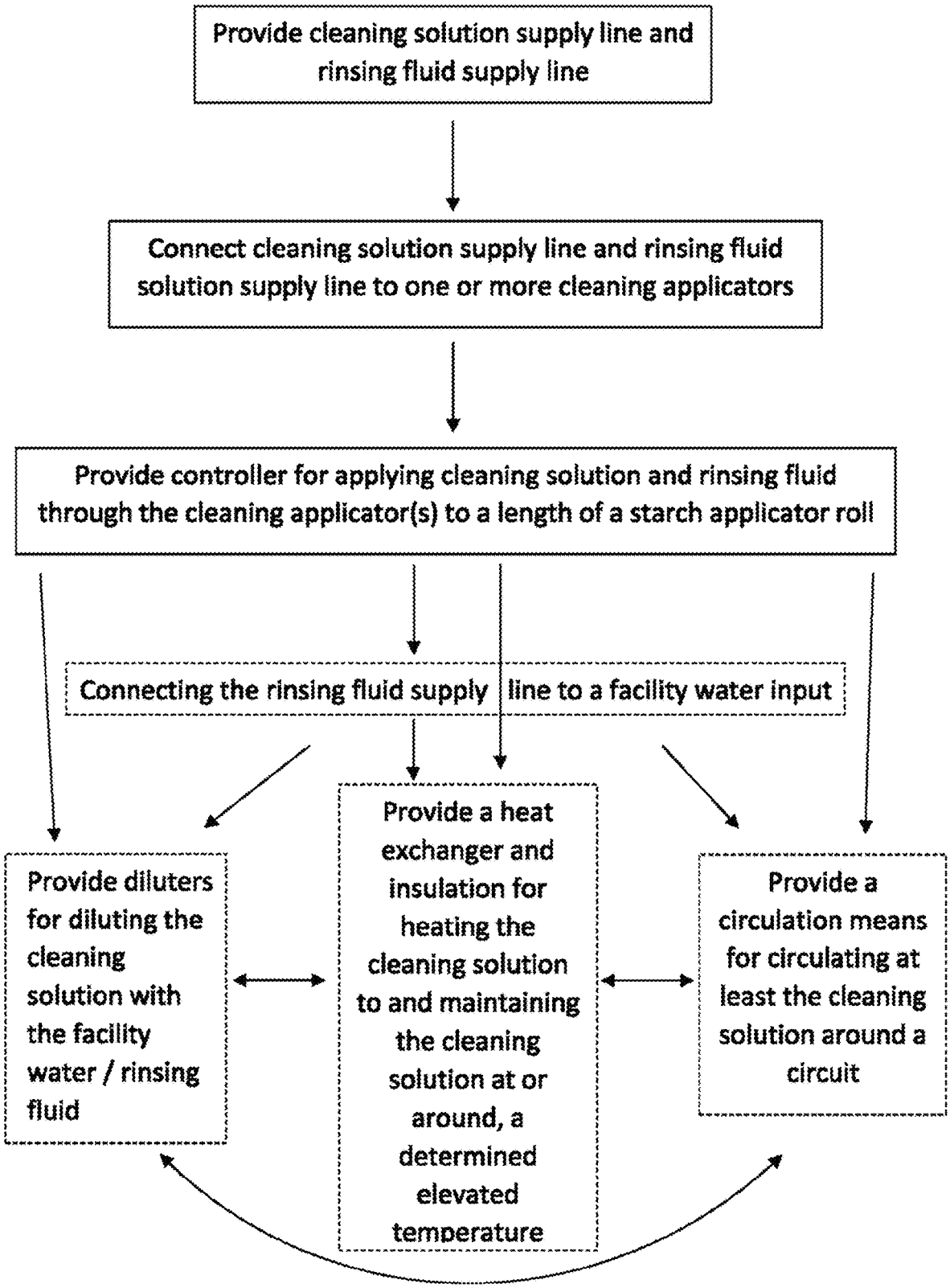
FIG. 6 is a flow diagram of the steps of a method to remove starch, including optional additional steps, in accordance with a method of the invention.

Turning to FIG. 6, there is shown a flow diagram representing the steps of a method to remove starch from a starch applicator roll of a starch applicator system, including optional additional steps. The first step involves providing a cleaning solution supply line and rinsing fluid supply line, the next step includes connecting the cleaning solution supply line and rinsing fluid solution supply line to one or more cleaning applicators; and the third step includes providing a controller for applying cleaning solution and rinsing fluid through the cleaning applicator(s) to a length of a starch applicator roll.

The next steps in the method are depicted in text boxes having a dashed perimeter, which signifies that each of those steps are optional steps of the invention such that one or more of those steps may be taken, or none of them, in addition to the first two steps. The optional steps include one or more of the following: connecting the rinsing fluid supply line to a facility water input; providing diluters for diluting the cleaning solution with the facility water/rinsing fluid; providing a heating means for heating the cleaning solution to and/or maintaining the cleaning solution at or around, a determined elevated temperature; and/or providing a circulation means for circulating at least the cleaning solution around a circuit (e.g. a circuit around the starch applicator system including the starch line, starch tray, etc.; or a foaming application circuit for foaming application of the solution).

Figure 7:
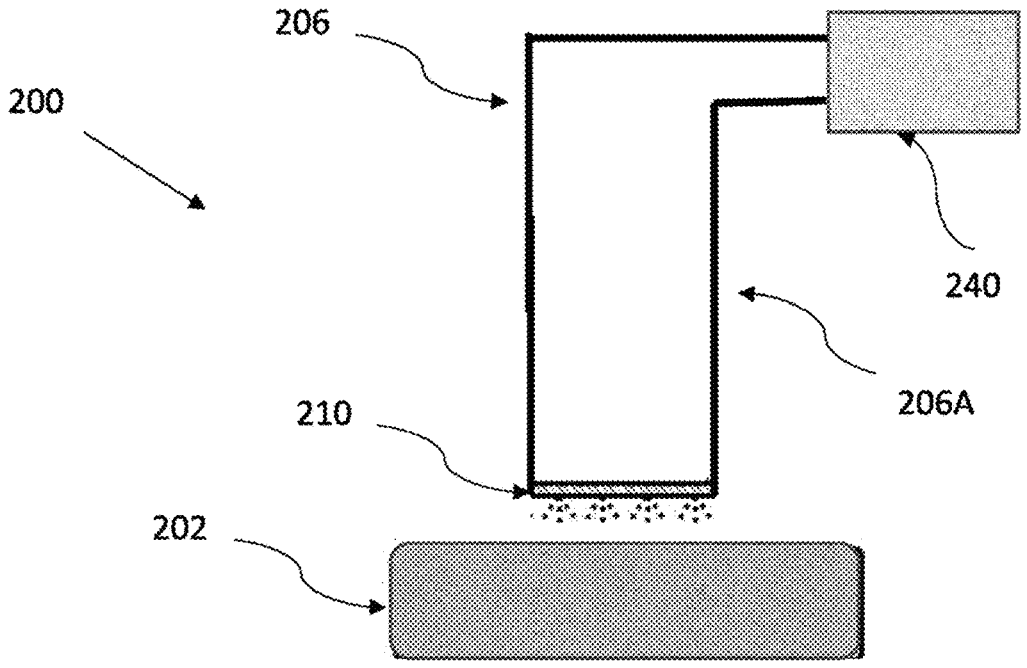
FIG. 7 is a diagrammatic view of a cleaning system for a starch applicator roll in accordance with an embodiment of the invention.
Figure 8:
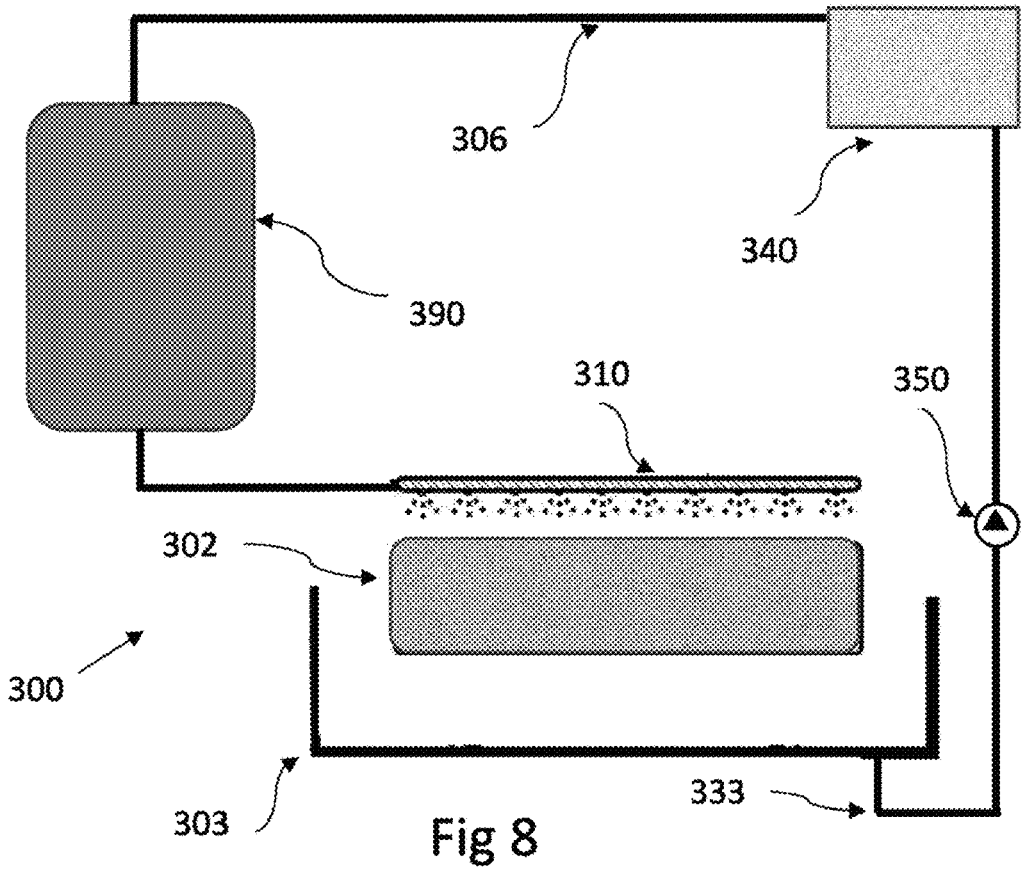
FIG. 8 is a diagrammatic view of a cleaning system for a starch applicator roll, including a heating means and providing for fluid recycling in accordance with an embodiment of the invention.

Turning to FIGS. 7 and 8, there is provided a diagrammatic view of a cleaning system 200 for a starch applicator roll 202, and of a cleaning system 300 for a starch applicator roll 302, including a heating means 390 and providing for fluid recycling, respectively.

In relation to FIG. 7, there is provided a first fluid line comprising a cleaning solution line 206 for supplying cleaning solution to the applicator 202, and a second fluid line comprising a rinsing fluid line 206A for supplying the rinsing fluid to the applicator 202.

The cleaning solution and rinsing fluid (not shown) are delivered via the fluid lines 206, 206A to an applicator comprising a spray shower head 210. The outlets on the shower head 210 are configured to spray fluid along a length of the starch applicator roll 202.

FIG. 8 depicts a starch cleaning system 300 including a combined cleaning solution/rinsing fluid line 306, connected to a heat exchanger 390 for heating the cleaning solution/rinsing fluid to about 70 degrees Celsius. After passing through the heat exchanger 390, cleaning solution/rinsing fluid is supplied to spray bar 310 which extends along the length of the applicator roll 302. The outlets of the spray bar 310 are positioned to spray fluid comprising either the cleaning solution or the rinsing fluid along the length of the applicator roll 302. The fluid then falls into the starch tray 303 and via return line 333 is returned, with the aid of circulation fluid pump 350, to the controller so that the fluid may be recycled around the circuit (including the line 306, the exchanger 390 and spray bar 310, the starch tray 303 and return line 333) continuously for a period of time that is the controller 340 is programmed to follow.

In relation to the heat exchanger 390, this comprises a series of coils (not shown) surrounded by a fluid having an elevated temperature. The cleaning solution/rinsing agent is run through the coils and in this way is indirectly heated. This arrangement minimizes risk of denaturing the enzymes in the cleaning solution that may occur when heating elements directly contact the solution for heating.

The recycling of fluid in the system of FIG. 8 is assisted gravity which acts as circulation means in parts of the circuit. Return line 333 includes discharge outlet (not shown) for discharging the cleaning solution and rinsing fluid at the conclusion of the relevant cycle.

The section of the line 306 between the heat exchanger 390 and the spray bar 310 may including other means such as insulation for maintaining the temperature at or around the desired temperature of 70 degrees.

In relation to both FIG. 7 and FIG. 8, the cleaning solution comprises alpha amylase in an amount in the range of about 10% w/w to break down the starch into water-soluble units, a pH control agent to control the acidity of the composition to about 6.5; a non-ionic surfactant (alkyl polyglucoside) of about 9% w/w; and a solvent (Ethylene Glycol Mono Butyl Ether) in the range of about 4% w/w adapted to soften the resins in the starch.

The controllers 240, 340 of each of the depicted cleaning systems control supply of cleaning solution composition (not shown) to the cleaning solution supply line 206, 306, and control supply of rinsing fluid (not shown) to the rinsing fluid supply 206, 306. The controllers 240, 340 of this embodiment are each connected to a supply of cleaning solution (not shown), as well as a supply of rinsing fluid (also not shown). Both controllers are programmable and implemented by electrically controlled means including a user interface for receiving a code to operate the cleaning and rinsing cycles and for automatic operation according to pre-programmed cycles.

The controllers of each of FIG. 7 and FIG. 8 are programmed to apply cleaning solution first for a minimum period of 30 minutes, then a rinsing solution for a period thereafter until the cleaning solution has been washed away from the applicator roll (and tray for FIG. 8).

Figure 9:
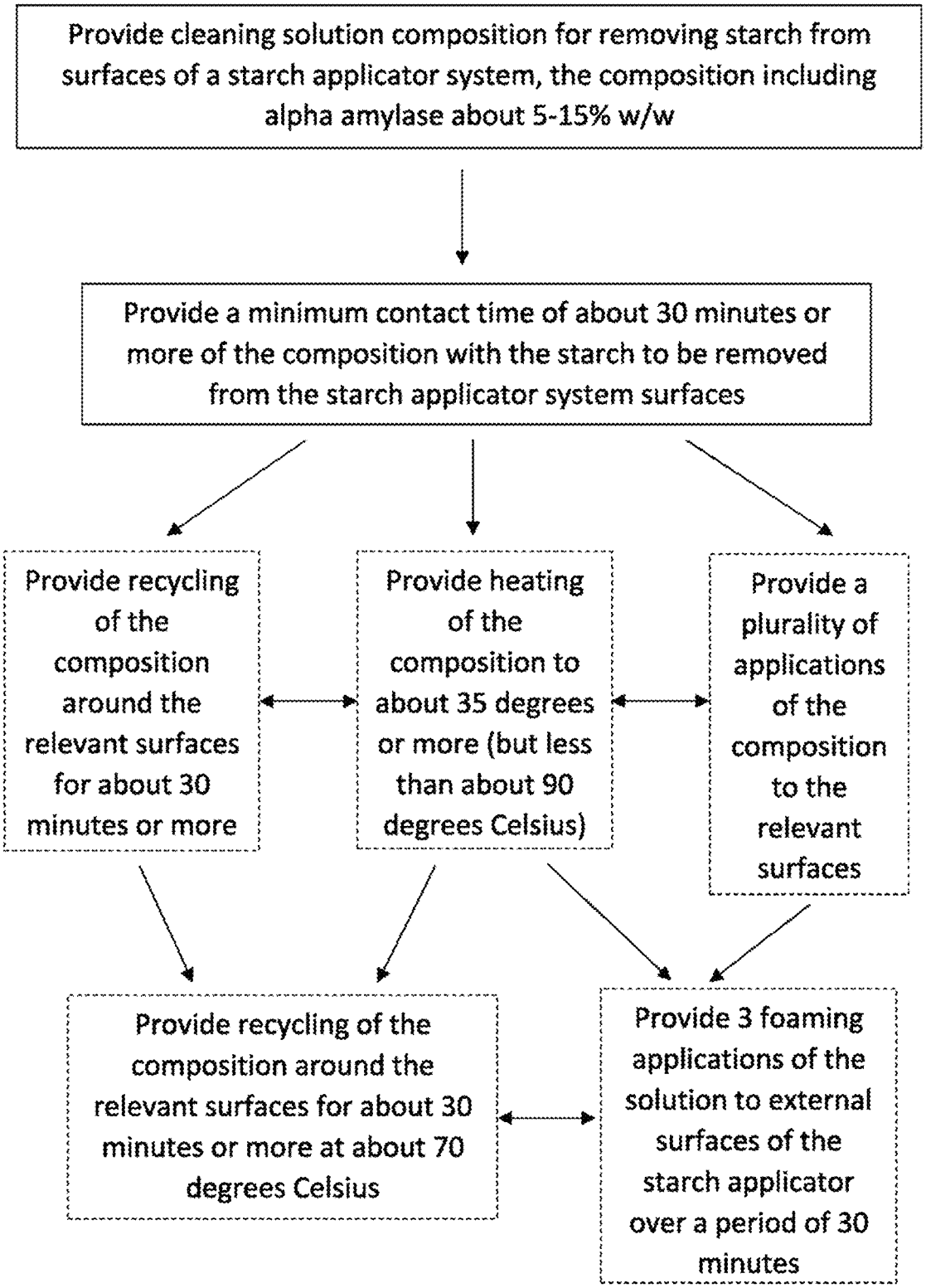
FIG. 9 is a flow diagram of the steps of a method for removing starch from surfaces of a starch applicator system, including optional additional steps, in accordance with a method of the invention.

Turning to FIG. 9, there is shown a flow diagram representing the steps of a method to remove starch, including optional additional steps. The first step involves providing a cleaning solution composition for removing starch from surfaces of a starch applicator system the composition including alpha amylase about 5-15% w/w. The second step comprises providing a determined contact time of about 30 minutes or more of the composition with the starch to be removed from the starch applicator system surfaces.

The next steps in the method are depicted in text boxes having a dashed perimeter, in order to signify that each of those steps are optional steps of the invention such that one or more of those steps may be taken, or none of them, in addition to the first two steps. For example, the method may provide for recycling without heating the composition; or the method may include heating the composition to about 60-80 degrees for recycling and/or heating the composition to about 40 degrees for foaming application; or none of those options.

The invention thus provides a thorough automatic cleaning system and method which helps maintain a starch application system in an optimal state without significant labor costs and preventing starch residue buildup.

It can also be seen that one or more of the following benefits may be delivered by the proposed invention: gains in production time; gains in time for maintenance; a reduction in the cost of waste water processing and the cost of water used; reducing board warping or delamination; a reduction in starch usage by significant percentages; reduction in the need to replace equipment, and in particular starch applicator rolls, starch pumps and piping.

The invention also provides a composition which is particularly suited for starch removal, and further, which is able to be used as the cleaning solution in the methods or the systems described herein.

Persons skilled in the art will appreciate that many variations may be made to the invention without departing from the scope of the invention, which is determined from the broadest scope and claims.

For example, while the embodiment shows the cleaning solution supply line and the water supply line to share a common path, in the broadest scope cleaning solution and rinsing water may be provided through separate supply lines.

Further, while the cleaning solution outlets separately direct cleaning solution to the starch applicator roll 2 and the starch tray 3 in the embodiment described above, in the broadest aspects cleaning solution outlets may direct cleaning solution directly onto one of starch applicator roll 2 or starch tray 3 and rely on mixing between the surfaces.

Further still, while the return valve of the embodiment described above is a three-way valve adapted to direct cleaning solution back to starch pot 4 or to a drain, in the broadest aspect the return valve may be a separate valve and separate outlet for recirculation.

Further also, while the cleaning applicators of the embodiment described above are spray applicators, other forms of application of fluid as are known in the art are within the broadest aspect of the invention.

Further also, while the cleaning solution of the embodiment described comprises an alpha-amylase enzyme and solvents, other effective cleaning solutions for cleaning starch applicator systems are within the broadest scope of the invention.

Further, the term 'fluid' in the singular or plural, may, unless the context indicates otherwise, refer to any one of, or any combination of starch, cleaning solution and/or rinsing agent Further, the cleaning solution may be an all in one cleaning and rinsing solution so that there may be no need for a separate cleaning and rinsing cycle, nor separate cleaning solution or and rinsing fluid lines (though it is acknowledged that both could be separately supplied along the same line, in any case).

The compositions, methods and/or systems of the invention may be applied in new starch applicator system environments. However, the compositions, systems and/or methods of the invention are particularly suited to retrofit application to existing equipment including a starch applicator and related components. The invention is able to remove starch from existing surfaces such starch applicator rolls, starch lines, starch trays and surrounding surfaces. In particular, where recycling of the composition is applied, the invention is conceived to take advantage of such equipment (especially the starch lines and the starch pump) as such existing equipment may assist in delivering the cleaning solution (and/or rinsing fluid) to the locations contemplated by the invention.

INTERPRETATION

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth.

However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

The terms in the claims have the broadest scope of meaning they would have been given by a person of ordinary skill in the art as of the relevant date.

The terms "a" and "an" mean "one or more", unless expressly specified otherwise

Neither the title nor any abstract of the present application should be taken as limiting in any way the scope of the claimed invention Where the preamble of a claim recites a purpose, benefit or possible use of the claimed invention, it does not limit the claimed invention to having only that purpose, benefit or possible use.

In the present specification, terms such as "part", "component", "means", "section", or "segment" may refer to singular or plural items and are terms intended to refer to a set of properties, functions or characteristics performed by one or more items having one or more parts. It is envisaged that where a "part", "component", "means", "section", "segment", or similar term is described as consisting of a single item, then a functionally equivalent object consisting of multiple items is considered to fall within the scope of the term; and similarly, where a "part", "component", "means", "section", "segment", or similar term is described as consisting of multiple items, a functionally equivalent object consisting of a single item is considered to fall within the scope of the term. The intended interpretation of such terms described in this paragraph should apply unless the contrary is expressly stated or the context requires otherwise The term "connected" or a similar term, should not be interpreted as being limitative to direct connections only. Thus, the scope of the expression an item A connected to an item B should not be limited to items or systems wherein an output of item A is directly connected to an input of item B. It means that there exists a path between an output of A and an input of B which may be a path including other items or means. "Connected", or a similar term, may mean that two or more elements are either in direct physical or electrical contact, or that two or more elements are not in direct contact with each other yet still co-operate or interact with each other.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to industries, such as paper manufacturing, in which the removal of starch from surfaces has commercial and practical implications.

What is claimed is:

1. A composition for removal of a resin-injected starch buildup on a surface of machinery or equipment, the composition comprising:

a) at least one surfactant in an amount, in a range of about 4% to about 12% w/w, effective to react at an interface of the resin-injected starch buildup and a surface of machinery or equipment to which the resin-injected starch buildup is attached;

b) at least one solvent in an amount, in a range of about 2% w/w to about 6% w/w, effective to liquefy a resin in the resin-injected starch buildup, the solvent selected from the group consisting of Ethylene Glycol Mono Butyl Ether, D-limonene and pine oil; and c) alpha amylase in an amount, in a range of about 8 to 15% w/w, effective to break down the resin-injected starch buildup into water-soluble units.

2. The composition according to claim 1, wherein the at least one solvent is Ethylene Glycol Mono Butyl Ether.

3. The composition according to claim 1, wherein the alpha amylase is present in an amount of about 10% w/w.

4. The composition according to claim 1, wherein the at least one surfactant is one or more of alkyl polyglucoside and sodium lauryl ether sulfate.

5. The composition according to claim 1, wherein the at least one surfactant is present in an amount of about 9% w/w.

6. The composition according to claim 1, wherein the machinery or equipment comprises a corrugator.

7. The composition according to claim 1, wherein the composition further includes a pH control agent to control acidity of the composition to about 6.

8. The composition according to claim 1, wherein identified constituents of the composition and/or their relative weighting inhibit denaturing of the alpha amylase.

9. The composition according to claim 1, wherein the composition is effective for removing starch at a temperature in a range of about 40 degrees Celsius to about 90 degrees Celsius.

10. An undiluted composition for removal of a resin-injected starch buildup attached to the surface of a corrugator, the composition comprising:

a) at least one surfactant in an amount, in a range of about 4% to about 12% w/w, effective to react at an interface of the resin-injected starch buildup and a surface of the corrugator to which the resin-injected starch buildup is attached;

b) at least one solvent in an amount, in a range greater than 2% w/w, effective to liquefy a resin in the resin-injected starch buildup, the solvent selected from the group consisting of Ethylene Glycol Mono Butyl Ether, D-limonene and pine oil; and c) alpha amylase in an amount, in a range of about 8 to 15% w/w, effective to break down the resin-injected starch buildup;

wherein the composition is effective for removal of the resin-injected starch buildup from the surface of the corrugator, and wherein the composition is maintained at a predetermined temperature.

11. The composition according to claim 10, wherein the alpha amylase enzyme is present in an amount of about 10% w/w.

12. The composition according to claim 10, wherein the surfactant is a non-ionic surfactant comprising alkyl polyglucoside.

13. The composition according to claim 10, wherein the at least one solvent is present in an amount in a range of about 2% to 6% w/w.

14. The composition according to claim 10, wherein the composition further includes a pH control agent to control acidity of the composition in a range of about 6 to 8.

15. The composition according to claim 10, wherein the predetermined temperature is about 35 degrees Celsius to about 90 degrees Celsius.

* * * * *